US010274271B2

(12) United States Patent
Cozzo et al.

(10) Patent No.: US 10,274,271 B2
(45) Date of Patent: Apr. 30, 2019

(54) APPARATUS FOR FIELD MAINTENANCE OF JAMMED FIREARMS

(71) Applicants: Nicholas Salvatore Cozzo, Arlington, VA (US); Glenn Promisco, Elmwood Park, IL (US)

(72) Inventors: Nicholas Salvatore Cozzo, Arlington, VA (US); Glenn Promisco, Elmwood Park, IL (US)

( * ) Notice: Subject to any disclaimer, the term of this patent is extended or adjusted under 35 U.S.C. 154(b) by 0 days.

(21) Appl. No.: 15/227,277

(22) Filed: Aug. 3, 2016

(65) Prior Publication Data

US 2017/0045320 A1 Feb. 16, 2017

Related U.S. Application Data

(60) Provisional application No. 62/203,169, filed on Aug. 10, 2015.

(51) Int. Cl.

| | |
|---|---|
| ***F41A 11/00*** | (2006.01) |
| ***F41A 3/72*** | (2006.01) |
| ***F41A 15/00*** | (2006.01) |
| ***F41A 15/12*** | (2006.01) |
| ***F41A 15/22*** | (2006.01) |
| ***F41A 35/00*** | (2006.01) |
| *F41A 5/24* | (2006.01) |

(52) U.S. Cl.

CPC ..... *F41A 3/72* (2013.01); *F41A 11/00* (2013.01); *F41A 15/00* (2013.01); *F41A 15/12* (2013.01); *F41A 15/22* (2013.01); *F41A 35/00* (2013.01); *F41A 5/24* (2013.01)

(58) Field of Classification Search

CPC .. F41A 9/37; F41A 9/375; F41A 11/00; B25B 13/08

USPC ..... 42/83, 90, 108

See application file for complete search history.

(56) References Cited

U.S. PATENT DOCUMENTS

| | | | | |
|---|---|---|---|---|
| 317,318 A * | 5/1885 | Davis | B25B 7/22 29/245 |
| 1,138,572 A * | 5/1915 | Kaylor | B25B 13/08 81/119 |
| 1,571,580 A * | 2/1926 | Fishburn | B25B 13/04 7/100 |
| 3,121,356 A * | 2/1964 | Davis | B25B 13/08 81/125.1 |

(Continued)

FOREIGN PATENT DOCUMENTS

DE 102007037259 * 2/2009

OTHER PUBLICATIONS

AR 10 magwell dimensions; 12 pages; Nov. 8, 2017.*

(Continued)

*Primary Examiner* — Stephen Johnson

(74) *Attorney, Agent, or Firm* — Morriss O'Bryant Compagni Cannon, PLLC

(57) ABSTRACT

Elements of the present invention relate to the application of force to a bolt carrier within a firearm when the firearm becomes inoperable. Some elements relate to the application of force by leverage applied with a bar inserted through a weapon's magazine well. Some elements relate to a bar end with prongs that provide for clearance of a weapon's bolt shaft while engaging the weapon's bolt carrier. Some elements relate to accommodation of multiple weapon dimensions with a single tool.

20 Claims, 9 Drawing Sheets

(56) References Cited

U.S. PATENT DOCUMENTS

| | | | | | |
|---|---|---|---|---|---|
| 3,318,192 | A * | 5/1967 | Miller et al. | F41A 3/26 | 42/106 |
| 3,440,926 | A * | 4/1969 | Gura | F41A 7/06 | 307/132 E |
| 3,630,118 | A * | 12/1971 | Stoner | F41A 3/26 | 89/13.05 |
| 5,031,488 | A * | 7/1991 | Zumeta | B25B 13/06 | 116/335 |
| 6,176,031 | B1 * | 1/2001 | Ramsey | F41C 9/085 | 42/83 |
| 6,276,240 | B1 * | 8/2001 | Blacklock | B25B 13/08 | 81/119 |
| 7,117,767 | B1 * | 10/2006 | Kiat | B25B 13/08 | 81/119 |
| 7,146,884 | B2 * | 12/2006 | Chaconas | B25B 13/08 | 81/119 |
| 2010/0269639 | A1 * | 10/2010 | Sroka | B25B 13/463 | 81/58.2 |
| 2015/0122090 | A1 * | 5/2015 | Ott | B25F 1/02 | 81/437 |

OTHER PUBLICATIONS

Width of an AR 15 magwell; 3 pages; Nov. 8, 2017.*
Snider, D; AR15 Lower Receiver; CAD Drawings; Feb. 14, 1993; http://www.biggerhammer.net/ar15/cad/ar15_receiver.pdf.
SSI Defense; .308 DPMS Compatible Lower Receiver; May 21, 2015; https://grabcad.com/requests/dpms-308-ar10-lower.
TR Enabling; AR-10 Lower Receiver; Oct. 4, 2013; https://www.tr-enabling.com/product-p/ar308ref.htm.

* cited by examiner

Section F-F

APPARATUS FOR FIELD MAINTENANCE OF JAMMED FIREARMS

CROSS-REFERENCE TO RELATED APPLICATIONS

The application claims priority to U.S. Provisional Patent Application No. 62/203,169 titled "Apparatus for Field Maintenance of Jammed Firearms" which was filed Aug. 10, 2015.

BACKGROUND OF THE INVENTION

1. Field of the Invention

The present invention relates to methods and apparatus for restoration of functionality to weapons when they become jammed.

2. Background and Related Art

Most modern firearms employ cartridges that are cycled into and out of a weapon's chamber for firing a projectile at a target. These cartridges are typically made of brass or another metal alloy that resists corrosion and has low friction characteristics. Some cartridges are made from steel, but have a lacquer coating or some other coating to impede corrosion. Steel cartridges are typically vastly inferior to brass, but are produced more economically.

A typical rifle cartridge may be described with reference to FIGS. 1 and 2, which is a side view of a typical rifle cartridge. A typical rifle cartridge 1 comprises a brass or metallic body 2 with a rim 6 at the base of the cartridge and extractor groove 8 for manipulating the cartridge during loading and extraction operations. The shoulder 10 and neck 12 serve to taper a larger cartridge down to the diameter of the bullet or projectile 4. A cartridge is typically hollow and is filled with a specific amount of propellant, otherwise known as gun powder. The projectile 4 is typically placed into the open end of the cartridge neck with a friction fit so that it does not slide out before firing.

FIG. 2 shows an end view of the cartridge shown in FIG. 1 with the outer diameter of the cartridge base defined by the rim 6. This typical cartridge is a centerfire cartridge wherein the center of the cartridge base comprises a hole 20 into which a primer is friction fit. The primer serves to ignite the propellant in the cartridge when the primer is struck by the firing pin of a weapon.

The typical cartridge shown is the most common in military, hunting, target and other sport rifles and has a rebated rim that has an outer diameter typically slightly smaller than the body diameter of cartridge. However, another common cartridge type has a rim that protrudes beyond the diameter of the cartridge with no extractor groove.

A cartridge is typically manipulated into and out of a weapon's firing chamber by the weapon's action. Many types of actions are in use today, but the most common are manual actions, such as the bolt action, lever action and pump action, the semi-automatic action and the automatic or fully-automatic action.

The manual action weapons require manual manipulation of a bolt, lever or sliding forearm "pump" to manually extract and load cartridges from and into the firing chamber. A semi-automatic weapon automatically loads and extracts a cartridge into and out of a weapon once each time the trigger is pulled. The user needs only to pull the trigger each time he/she desires to fire the weapon until the magazine is empty. A fully-automatic weapon's action loads cartridges into and out of the weapon automatically and continuously as long as the trigger remains pulled and the magazine contains cartridges.

When a cartridge is bent, deformed, dirty, corroded or has otherwise lost its standard geometric and/or frictional properties or when the weapon is dirty, corroded, damaged or otherwise impaired, the cartridge may become difficult to load or unload or may even jam somewhere in the action or in the firing chamber. This jamming is common when old, low-quality and/or dirty ammunition is used or when a weapon is dirty, unlubricated and/or damaged.

The AR-10 rifle is a semi-automatic, 7.62×51 mm NATO caliber weapon designed by Armalite Corporation. Several variants and copies have been manufactured and are still manufactured today. It uses a direct impingement gas action with a rotary bolt locking mechanism. The direct impingement gas operation design directs hot exhaust gases from the weapon barrel, through a tube, against a bolt key and then into the bolt carrier. This design allows hot combustion gases to flow over the bolt carrier and action of the weapon. After extended use, these combustion gases will cause a buildup of residue that can cause the action to jam.

The AR-15 is another Armalite-designed weapon that is basically a scaled down version of the AR-10 using the 5.56×45 mm caliber NATO cartridge. It uses the same basic design as the AR-10 and suffers from the same weaknesses in design. The AR-15 was modified for the US military and adopted as the M16 and M4 select-fire, fully-automatic weapons. When put into widespread military use in Vietnam, the M16 suffered from frequent jamming unless cleaned properly and used with ammunition employing clean-burning propellant.

As the design is a military standard, dozens of manufacturers now manufacture AR-15 or AR-15 style weapons. In fact, it is one of the most popular and ubiquitous rifles in the U.S. civilian market today while the M16 is an extremely common military weapon used in dozens of military forces across the world.

Other weapons with the same basic design include the DPMS Panther Arms LR-308, LRAP4 and GII AP4; the Colt MARC 901 rifles; and the Lewis Machine and Tool LM308SS in 7.62×51 mm caliber and many well-known models in 5.56×45 mm caliber from DPMS Panther Arms, Colt, LMT, Rock River Arms, Bushmaster, STAG Arms, Bravo Company USA, CMMG, Daniel Defense, Noveske, Sig Sauer, Smith & Wesson, Ruger and others.

Many automatic and semi-automatic weapons are susceptible to jamming if they are poorly lubricated or dirty as the actions are operated by gas pressure and spring return mechanisms that are specifically tuned for the forces encountered during normal operation. Hence, when friction forces build up, the weapon simply stops functioning because the spring forces are not balance to overcome the increased frictional forces in the action. With a manual action, the user can simply increase the force on the bolt, but with a semi-automatic, the spring force cannot be increased and the weapon jams.

While the AR-10 and AR-15 function well when cleaned and maintained properly and used with high quality ammunition, they can jam frequently when poorly lubricated and/or dirty. Typically, when the weapon jams, the bolt carrier, bolt or cartridge become stuck in the chamber or receiver. When this occurs, the action must be forced open manually.

BRIEF SUMMARY OF THE INVENTION

An apparatus is provided for convenient opening of a jammed action in a semi-automatic or automatic weapon.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Figure 1:
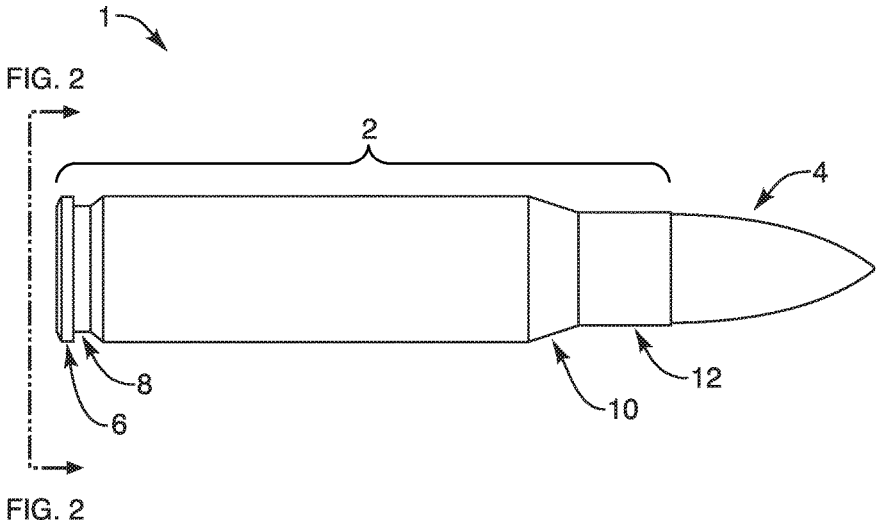
FIG. 1 (Prior Art)
FIG. 1 shows a typical, prior-art rifle cartridge in a side view.
Figure 2:
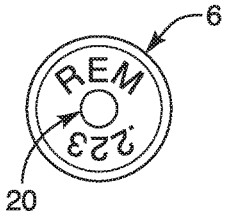
FIG. 2 (Prior Art)
FIG. 2 shows the typical, prior-art rifle cartridge of FIG. 2 in an end view.
Figure 3:
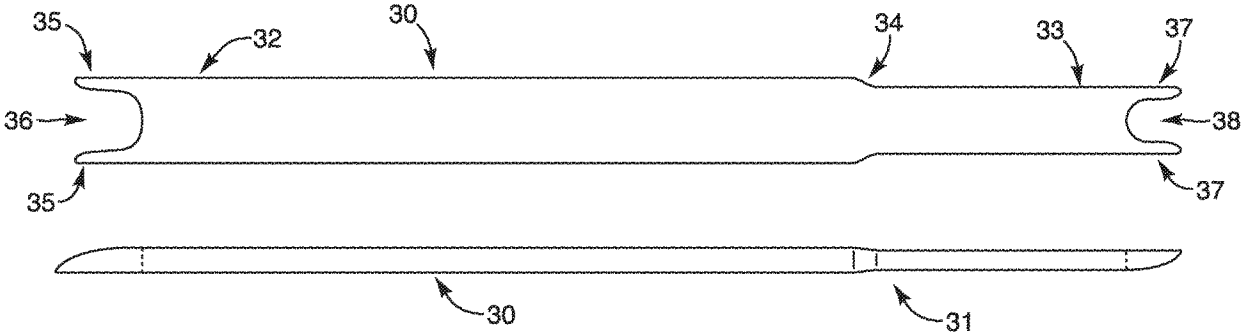
FIG. 3 shows an embodiment of the present invention in a flat format.

Some embodiments of the present invention can be described with reference to FIG. 3. These embodiments comprise a substantially rigid bar 30 that is approximately 0.5 cm thick 31 throughout its length and 2.5 cm wide at a wide end 32 while being approximately 1.8 cm wide at a narrow end 33. The wide end 32 of the bar 30 terminates in two wide-end prongs 35 on either side of the bar. These prongs 35 may be approximately 0.15 cm wide and may taper to a point at their ends. The gap 36 between the prongs 35 is approximately 2.3 cm wide (transverse to the bar's longitudinal axis) and approximately 1.5 to 2.5 cm deep (along the bar's longitudinal axis). In an exemplary embodiment, the wide-end prong length or wide-end gap depth may be 2.0 cm.

The narrow end 33 of the bar 30 may also terminate with two narrow-end prongs 37, which are approximately 0.4 cm wide. The gap 38 between the two narrow-end prongs 37 may be approximately 1.0 cm wide and approximately 1 cm deep along the longitudinal axis of the bar. In an exemplary embodiment, the narrow-end prong length or narrow-end gap depth may be 1.8 cm.

The taper 34 from the wide-end width of approximately 2.5 cm and the narrow-end width of 1.8 cm may occur at almost any place along the length of the bar, but, in a preferred embodiment, will occur at a location that is at least approximately 7.5 cm from the ends of the narrow-end prong tips, thereby making the narrow portion 33 of the bar 30 at least approximately 7.5 cm in length. In some embodiments, the narrow portion 33 of the bar 30 may extend almost the entire length of the bar 30 such that the taper 34 occurs near the wide-end prongs 35.

Embodiments of the present invention may be constructed of various materials such as steel, aluminum, brass and other metals and alloys as well as carbon fiber, high-strength plastics, fiberglass, fiberglass-reinforced plastic and combinations thereof. The thickness of the bar 30 may vary depending on the strength and rigidity of the materials employed.

Figure 4:
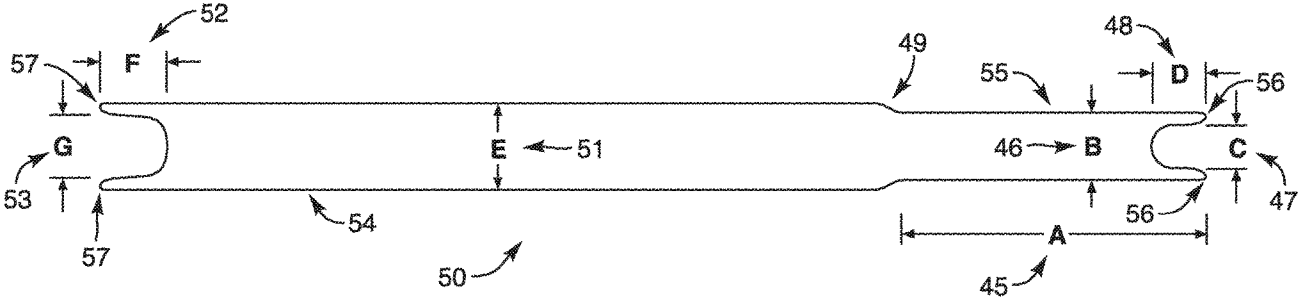
FIG. 4 shows an embodiment of the present invention with dimensions relative to generic firearm dimensions.

Some embodiments of the present invention may be described with reference to FIG. 4. These embodiments are described with relative dimensions that relate to common weapon dimensions. In these embodiments, the bolt manipulation bar 50 comprises a narrow end 55 and a wide end 54. Each end 54, 55 may terminate with two prongs 56, 57. In these embodiments, the narrow end 55 of the bar has a narrow-end length "A" 45 that is at least as long as the distance from the center of an AR-15/M16 rifle bolt to the base of the magazine well (magwell) on the AR-15/M16 rifle. These embodiments may further comprise a narrow-end width "B" 46 that is slightly less than the width of an AR-15/M16 magwell from side to side so that the narrow end 55 will fit into an AR-15/M16 magwell without an interference fit.

These embodiments may further comprise a gap width "C" 47 that is slightly wider than the diameter of an AR-15/M16 bolt shaft such that the prongs 56 at the narrow end 55 of the bar 50 will fit around the AR-15/M16 bolt shaft to engage the bolt carrier. These embodiments may further comprise a gap depth "D" 48 that is at least ½ the diameter of the AR-15/M16 bolt shaft diameter.

At the wide end 54 of the bar, some embodiments may comprise a wide-end width "E" 51 that is slightly less than the width of an AR-10 magwell such that the wide end 54 of the bar will fit into an AR-10 magwell without an interference fit. These embodiments may further comprise a wide-end gap width "G" 53 that is slightly larger than the diameter of an AR-10 bolt shaft such that the prongs 57 at the wide end 54 of the bar 50 may extend around the sides of an AR-10 bolt shaft. Some embodiments may further comprise a wide-end gap depth "F" 52 that is approximately ½ the diameter of an AR-10 bolt shaft, again allowing engagement of prongs 57 around the AR-10 bolt shaft.

Other embodiments of the present invention may be described with reference to FIG. 4.

These embodiments are described with relative dimensions that relate to generic firearm dimensions. In these embodiments, the bolt manipulation bar 50 comprises a narrow end 55 and a wide end 54. Each end 54, 55 may terminate with two prongs 56, 57. In these embodiments, the narrow end 55 of the bar has a narrow-end length "A" 45 that is at least as long as the distance from the center of a first firearm bolt to the base of the magazine well (magwell) of the first firearm. These embodiments may further comprise a narrow-end width "B" 46 that is slightly less than the width of a first firearm magwell from side to side so that the narrow end 55 will fit into a first firearm magwell without an interference fit.

These embodiments may further comprise a gap width "C" 47 that is slightly wider than the diameter of a first firearm bolt shaft such that the prongs 56 at the narrow end 55 of the bar 50 will fit around the first firearm bolt shaft to engage the bolt carrier. These embodiments may further comprise a gap depth "D" 48 that is at least ½ the diameter of the first firearm bolt shaft diameter.

At the wide end 54 of the bar, some embodiments may comprise a wide-end width "E" 51 that is slightly less than the width of a second firearm magwell such that the wide end 54 of the bar will fit into a second firearm magwell without an interference fit. These embodiments may further comprise a wide-end gap width "G" 53 that is slightly larger than the diameter of a second firearm bolt shaft such that the prongs 57 at the wide end 54 of the bar 50 may extend around the sides of a second firearm bolt shaft. Some embodiments may further comprise a wide-end gap depth "F" 52 that is approximately ½ the diameter of a second firearm bolt shaft, again allowing engagement of prongs 57 around the a second firearm bolt shaft.

Further embodiments of the present invention may be described with reference to FIG. 4. These embodiments are described with relative dimensions that relate to common weapon dimensions. In these embodiments, the bolt manipulation bar 50 comprises a narrow end 55 and a wide end 54. Each end 54, 55 may terminate with two prongs 56, 57. In these embodiments, the narrow end 55 of the bar has a narrow-end length "A" 45 that is at least as long as the distance from the center of an AR-15/M16 rifle bolt to the base of the magazine well (magwell) on the AR-15/M16 rifle. These embodiments may further comprise a narrow-end width "B" 46 that is slightly less than the width of an AR-15/M16 magwell from side to side so that the narrow end 55 will fit into an AR-15/M16 magwell without an interference fit.

These embodiments may further comprise a gap width "C" 47 that is slightly wider than the diameter of an AR-15/M16 bolt shaft such that the prongs 56 at the narrow end 55 of the bar 50 will fit around the AR-15/M16 bolt shaft to engage the bolt carrier. These embodiments may further comprise a gap depth "D" 48 that is at least ½ the diameter of the AR-15/M16 bolt shaft diameter.

At the wide end 54 of the bar, some embodiments may comprise a wide-end width "E" 51 that is slightly less than the width of a DPMS LR-308 magwell such that the wide end 54 of the bar will fit into a DPMS LR-308 magwell without an interference fit. These embodiments may further comprise a wide-end gap width "G" 53 that is slightly larger than the diameter of a DPMS LR-308 bolt shaft such that the prongs 57 at the wide end 54 of the bar 50 may extend around the sides of a DPMS LR-308 bolt shaft. Some embodiments may further comprise a wide-end gap depth "F" 52 that is approximately ½ the diameter of a DPMS LR-308 bolt shaft, again allowing engagement of prongs 57 around the DPMS LR-308 bolt shaft.

In some embodiments of the present invention the narrow-end and/or wide-end gap depths may be less than ½ the diameter of a rifle bolt and prong lengths may than stated above while still allowing at least partial engagement of the prongs with the bolt carrier. These embodiments may comprise smaller gap depths and prong lengths.

Figure 5:
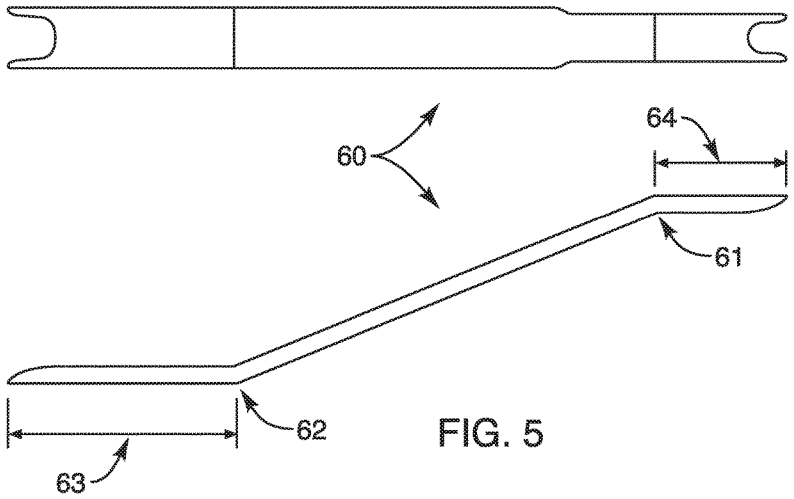
FIG. 5 shows an embodiment of the present invention with angular bend points.

Some embodiments of the present invention may be described with reference to FIG. 5. In these embodiments, the bar 60 is not a flat bar, but is bent at bend points 61 and 62. These bends provide a fulcrum that is closer than the bottom edge of the magwell thereby increasing leverage on the bolt during use as compared to a flat bar. Accordingly, the distances 63, 64 are less than the distance from the center of a weapon's bolt or barrel axis to the base of the magwell. In some embodiments the distances 63 and 64 may be different to accommodate two different weapons. In some embodiments, these weapons may be the AR-15/M16 and the AR-10. In some embodiments, these weapons will be the AR-15/M16 and the DPMS LR-308.

Figure 6:
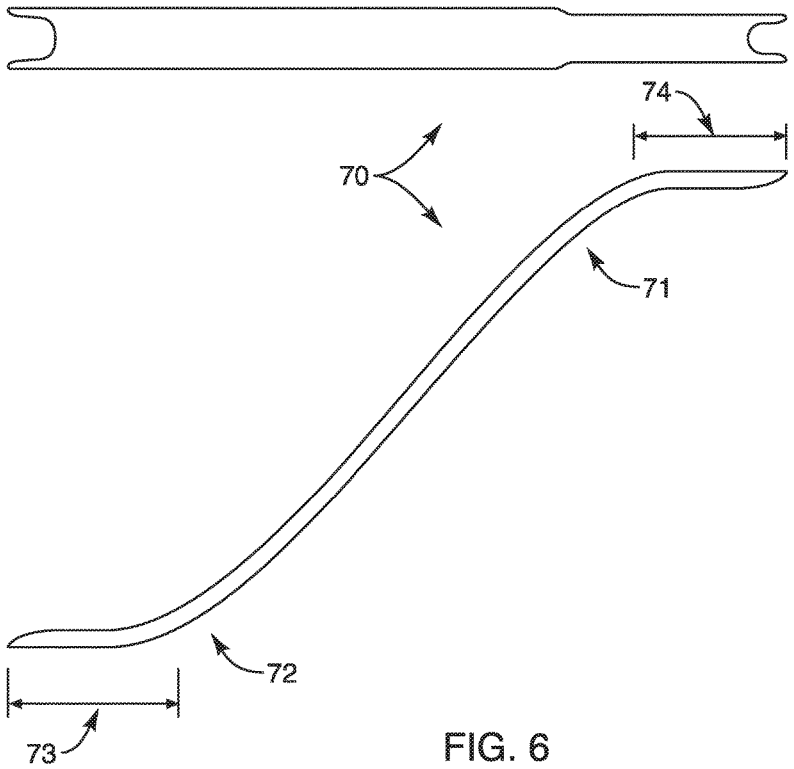
FIG. 6 shows an embodiment of the present invention with curved curve points.

Some embodiments of the present invention may be described with reference to FIG. 6. In these embodiments, the bar 70 is not a flat bar, but is curved at curve points 71 and 72. These curves provide a fulcrum that is closer than the bottom edge of the magwell thereby increasing leverage on the bolt during use as compared to a flat bar. Accordingly, the distances 73, 74 are less than the distance from the center of a weapon's bolt or barrel axis to the base of the magwell. In some embodiments the distances 73 and 74 may be different to accommodate two different weapons. In some embodiments, these weapons may be the AR-15/M16 and the AR-10. In some embodiments, these weapons will be the AR-15/M16 and the DPMS LR-308.

Figure 7:
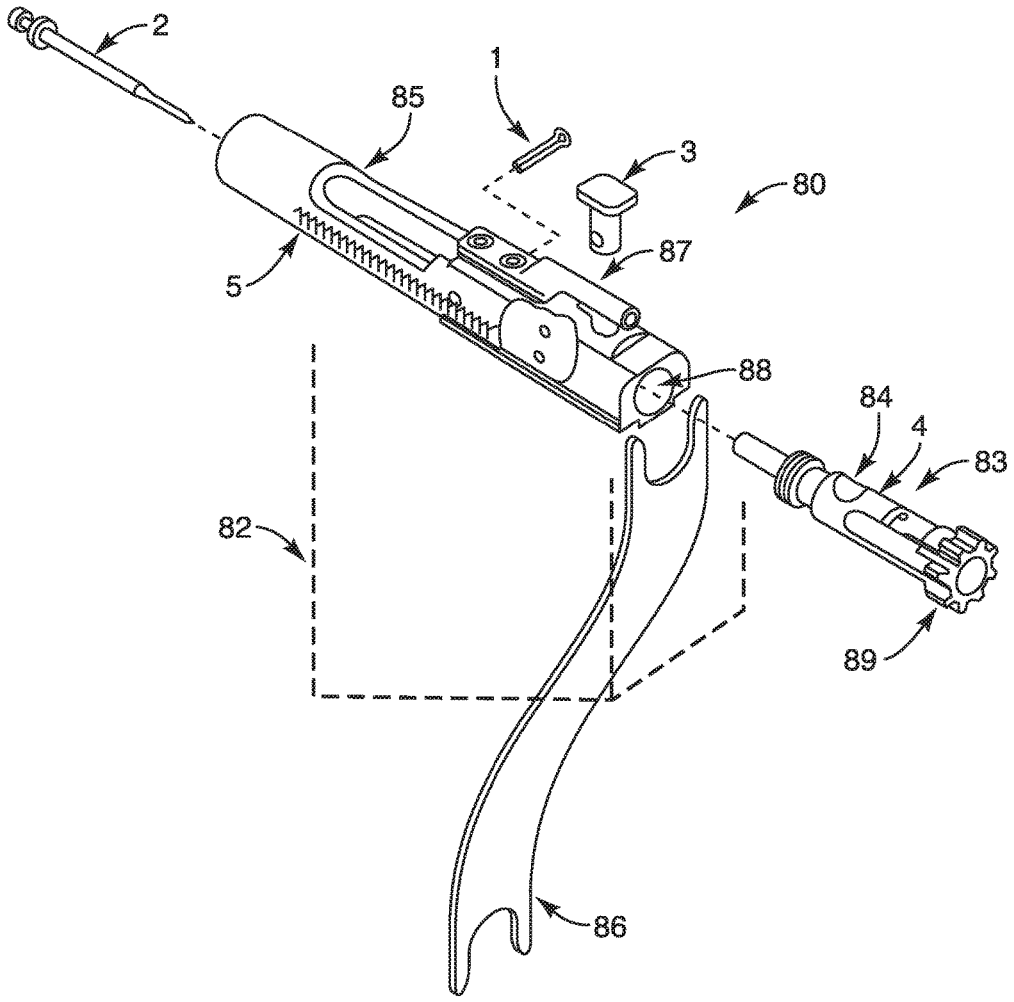
FIG. 7 shows an embodiment of the present invention in relation to an exemplary bot carrier group.

Some embodiments of the present invention may be described with reference to FIG. 7. FIG. 7 is a diagram illustrating the prior art bolt carrier group 80 of an AR-15/M16 rifle. The bolt carrier 85 is actuated by gas pressure on the gas key 87. The bolt 83 has a bolt shaft 84 that slides into a bolt hole 88 in the bolt carrier 85 and rotates within the bolt hole 88. Locking lugs 89 on the bolt engage a barrel extension (not shown) to lock the bolt in place during firing. In normal use, the bolt 83 will rotate the locking lugs 89 in the barrel extension to fire a cartridge and subsequently rotate again, in response to gas pressure on the gas key 87 to disengage the barrel extension and allow movement of the bolt to extract the spent cartridge and chambering of a new cartridge.

In a typical weapon, when assembled, the bolt carrier group 80 resides in an upper receiver (not shown) which is assembled with a lower receiver (partially shown) which comprises a magazine well 82. When fully assembled, the magazine well 82 is oriented below the bolt carrier as shown in FIG. 7. If the weapon becomes jammed, embodiments of the present invention 86 may be inserted into the magazine well (magwell) 82 and these embodiments 86 may be manipulated to engage the bolt carrier and pry against the bolt carrier so as to apply force against the bolt carrier and force it open. Once the bolt is opened, the weapon may be rendered safe for transport or for immediate maintenance.

Figure 8:
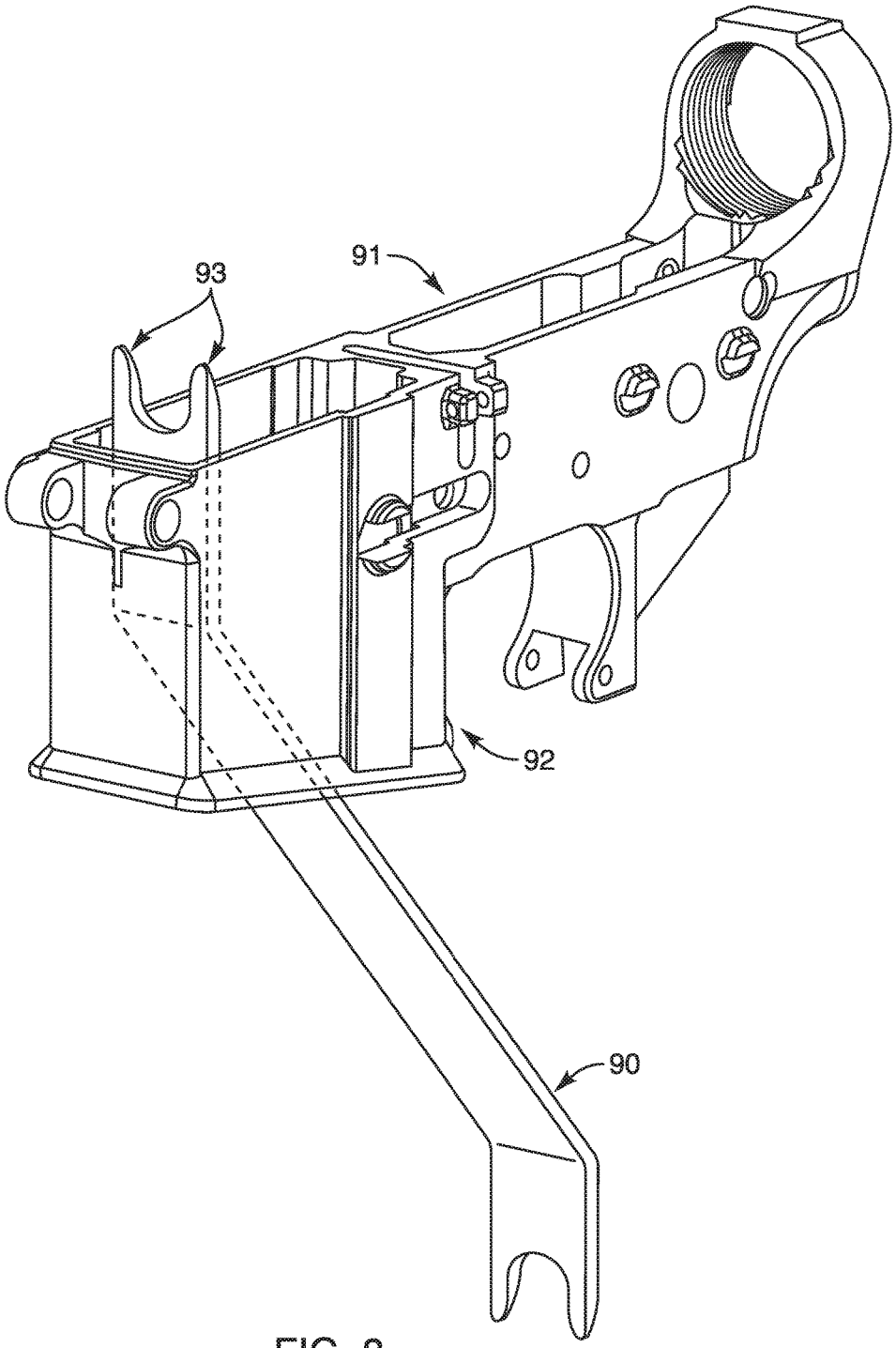
FIG. 8 shows an embodiment of the present invention in relation to an exemplary lower receiver of a weapon.

Some embodiments of the present invention may be described with reference to FIG. 8. These embodiments are illustrated with reference to a prior art lower receiver 91 for an AR-15/M16 rifle. This lower receiver 91 comprises an integral magwell into which a magazine may be inserted for feeding cartridges into the weapon during semi-automatic or automatic use. Embodiments of the present invention 90 may be inserted into the magwell 92 for manipulation of a bolt carrier (not shown in FIG. 8, but shown in FIG. 7) that resides above the magwell 92. As illustrated, it is evident that these embodiment must have a width 46, 51 (shown in FIG. 4) that is less that the width of the magwell 92 to allow movement within the magwell 92. However, these embodiments must be wide enough to accommodate prongs 93 that are spaced far enough apart to accommodate the bolt shaft 84 between them.

Figure 9:
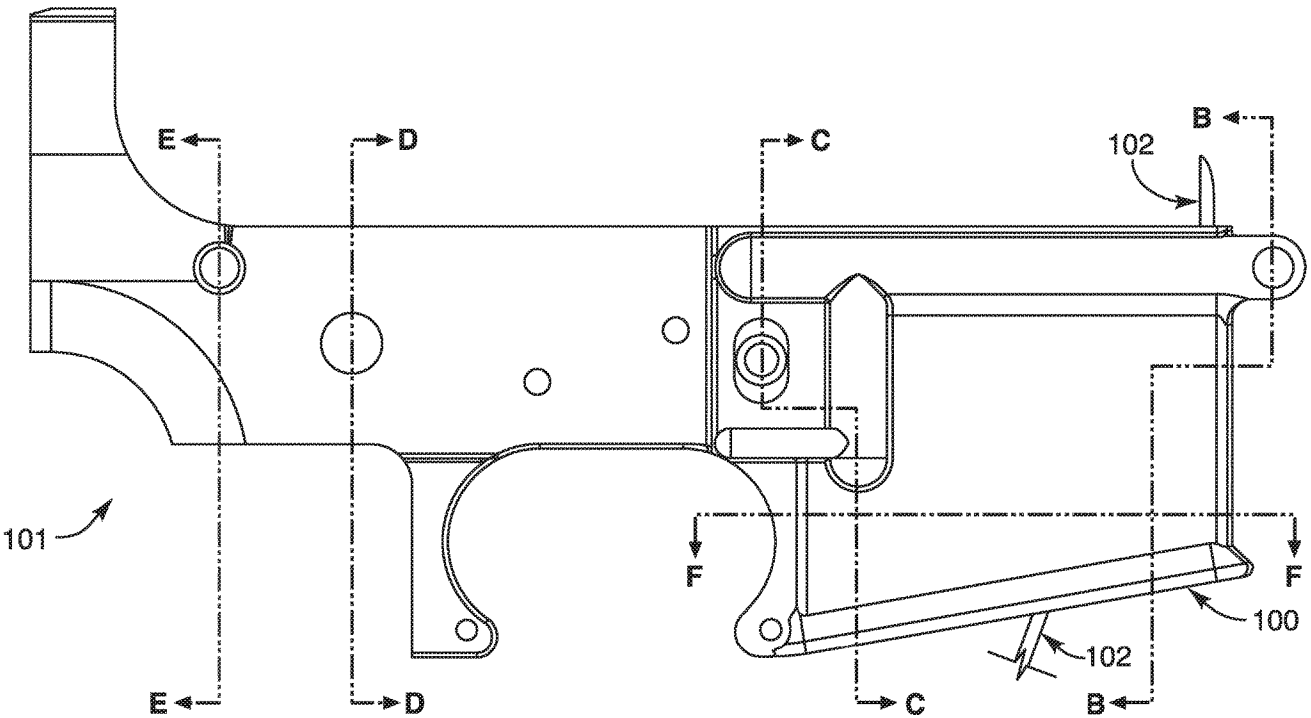
FIG. 9 shows a prior art exemplary lower receiver with integral magwell.

FIG. 9 is a side view of a prior art AR-15/M16 lower receiver 101 with an integral magwell 100 into which embodiments of the present invention 102 may be inserted. Typical dimensions of the lower receiver and magwell are illustrated therein.

Figure 10:
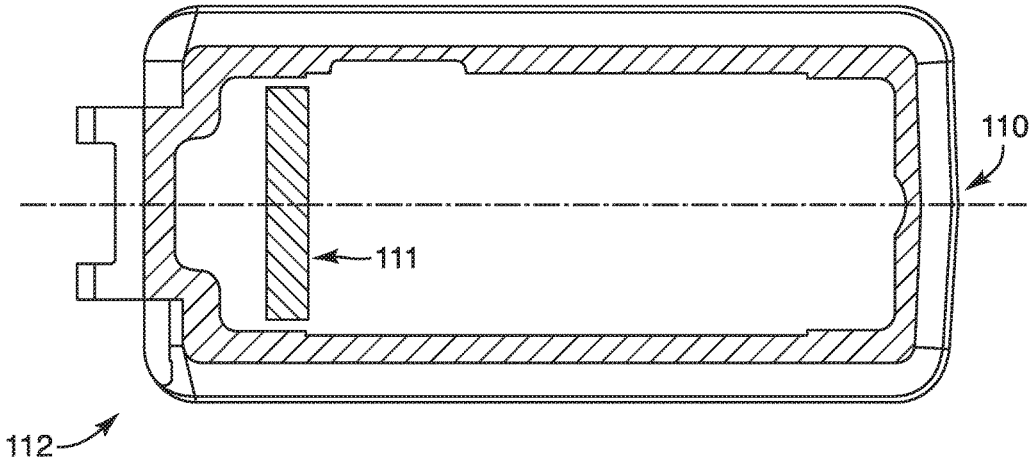
FIG. 10 shows a section view of an embodiment of the present invention in relation to an exemplary magwell with dimensions.

FIG. 10 is a sectional view of a prior art AR-15/M16 magwell 110 showing a section of an embodiment of the present invention 111 inserted in the magwell. Typical magwell dimensions are shown therein. The magwell width 112 is shown at 0.898 inches with a tolerance of +–0.010 inches. Accordingly, the width of an embodiment of the present invention that accommodates this weapon must be less than 0.888 inches. To allow clearance for uninhibited, non-interference movement within the magwell, an exemplary embodiment may have a width of less than 0.75 inches.

Figure 11:
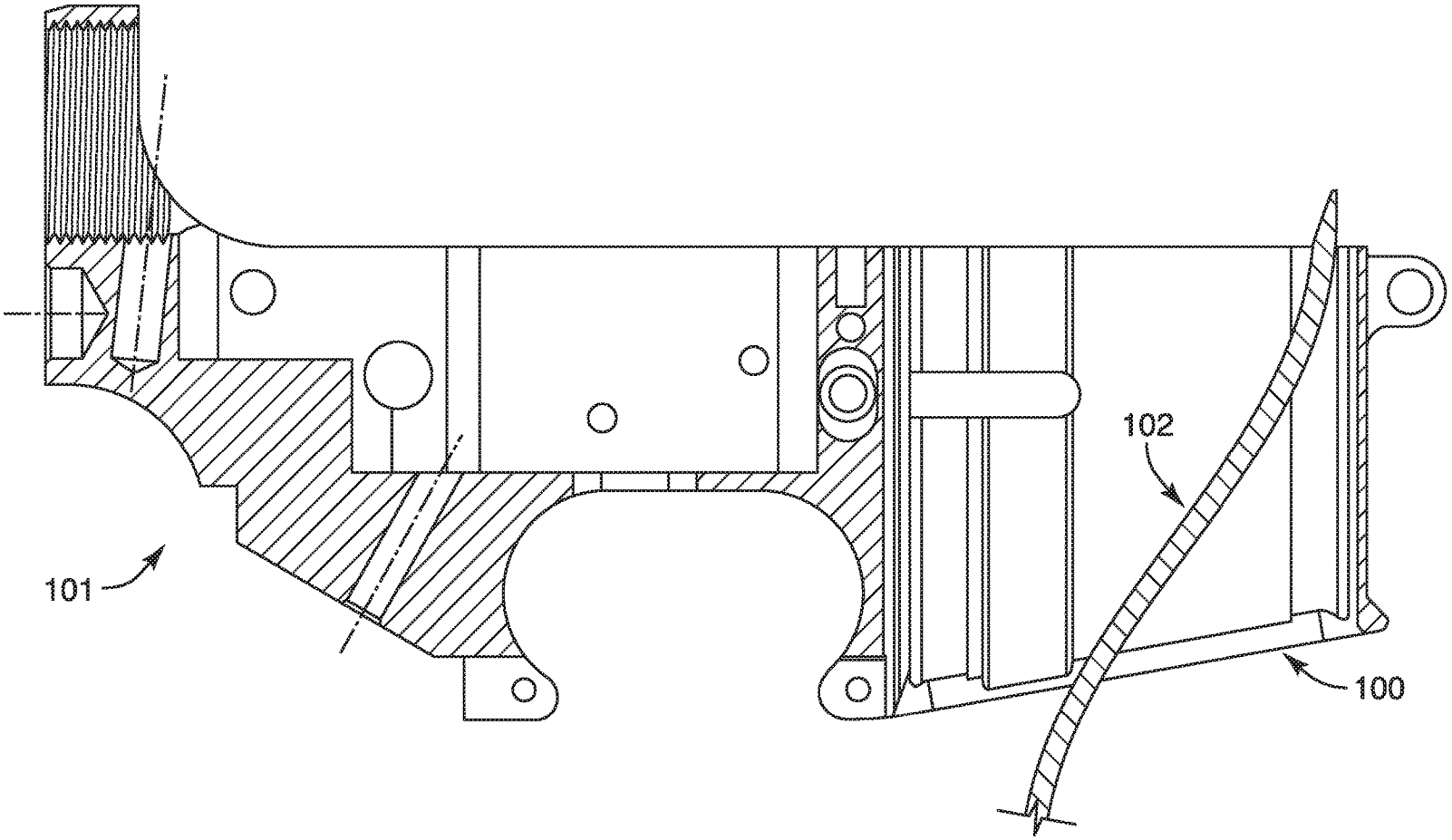
FIG. 11 is a side sectional view of an embodiment of the present invention in relation to an exemplary prior art lower receiver with integral magwell.

FIG. 11 is a diagram showing a sectional side view of a prior art AR-15/M16 lower receiver 101 with integral magwell 100. An embodiment of the present invention 102 is inserted into the magwell 100. Typical dimensions are shown thereon in inches.

Figure 12:
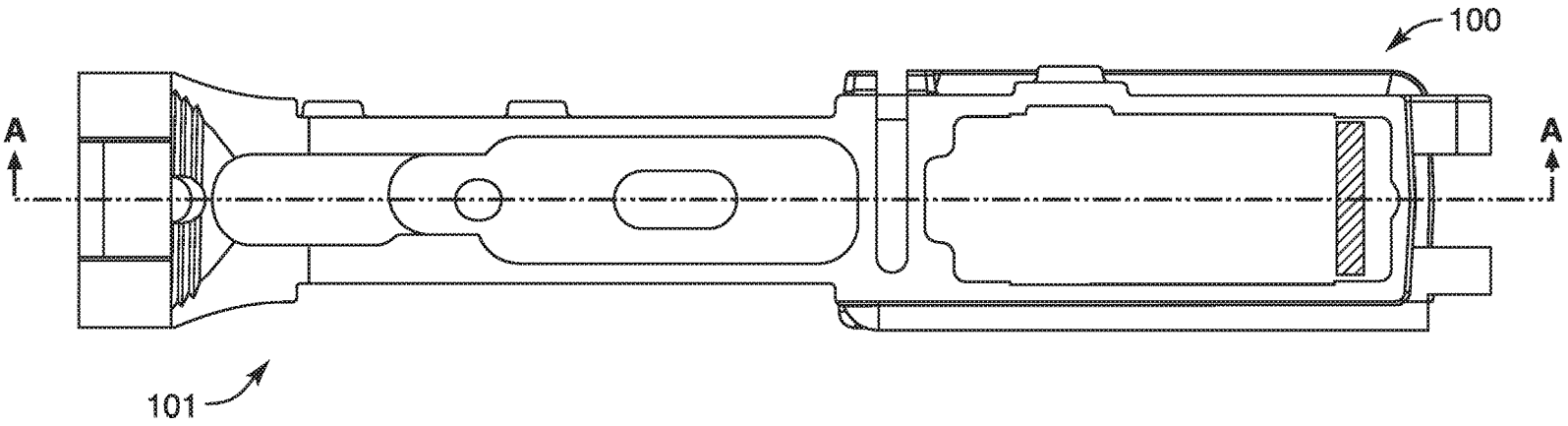
FIG. 12 is a top view of an embodiment of the present invention in relation to an exemplary lower receiver with integral magwell.

FIG. 12 is a diagram showing top view of a prior art AR-15/M16 lower receiver 101 with integral magwell 100 and an embodiment of the present invention 102 inserted into the magwell 100. Typical dimensions are shown thereon in inches.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An apparatus for applying force to a weapon bolt carrier via the weapon's magazine well, said apparatus comprising:

an elongate bar having a first end and a second end, the first end of the elongate bar comprising a first set of two elongate prongs integrally formed with the first end of the elongate bar, the first set of two elongate prongs longitudinally extending substantially parallel to a longitudinal axis of the elongate bar, outer surfaces of the first set of two elongate prongs being substantially parallel along their length to one another and extending substantially parallel to the longitudinal axis, the first set of two elongate prongs defining a first outer width of approximately 1.8 cm such that the first end of the elongate bar is configured to fit into an AR-15 magwell without interference fit and configured to pry a bolt carrier of the AR-15, first inner surfaces of the first set of two elongate prongs being substantially parallel along their lengths and defining and being separated by a first gap, at least a portion of each first inner surface of the first set of two elongate prongs having a length at least equal to a first gap width of the first gap, and the second end of the elongate bar comprising a second set of two elongate prongs integrally formed with the second end of the elongate bar, the second set of two elongate prongs longitudinally extending substantially parallel to the longitudinal axis of the elongate bar, outer surfaces of the second set of two elongate prongs being substantially parallel to one another along their length and extending substantially parallel to the longitudinal axis, the second set of two elongate prongs defining a second outer width of approximately 2.5 cm so that the second end of the elongate bar is configured to fit into an AR-10 magwell without interference fit and configured to pry a bolt carrier of the AR-10, second inner surfaces of the second set of two elongate prongs being substantially parallel to one another along their lengths and defining and being separated by a second gap, at least a portion of each second inner surface of the second set of two elongate prongs having a length at least equal to a second gap width of the second gap.

2. The apparatus of claim 1, wherein a first thickness of the elongate bar is less than the first and second outer widths of the elongate bar and wherein a top and bottom surface of the elongate bar from proximate the first end to proximate the second end of the elongate bar are substantially planar and substantially parallel.

3. The apparatus of claim 2, wherein a thickness of the first set of prongs is tapered from the first thickness of the elongate bar to a second thickness proximate terminal ends of the first set of prongs that is less than the first thickness.

4. The apparatus of claim 2, wherein a thickness of the second set of prongs is tapered from the first thickness of the elongate bar to a second thickness proximate terminal ends of the second set of prongs that is less than the first thickness.

5. The apparatus of claim 1, wherein the first inner surfaces of the first set of prongs are parallel to one another and planar along their respective lengths to proximate their respective terminal ends.

6. The apparatus of claim 1, wherein the second inner surfaces of the second set of prongs are parallel to one another and planar along their respective lengths to proximate their respective terminal ends.

7. The apparatus of claim 1, wherein the elongate bar, first set of prongs and second set of prongs are formed from a single length of steel.

8. The apparatus of claim 1, wherein a thickness of the elongate bar is less than the first and second widths of the elongate bar and wherein a top surface and a bottom surface of the elongate bar from proximate the first end to proximate the second end of the elongate bar are substantially planar and parallel.

9. The apparatus of claim 1, wherein the elongate bar includes a first bend spaced a first distance from the first end, the first distance being greater than a depth of insertion of the first end into the AR-15 magwell.

10. The apparatus of claim 9, wherein the elongate bar includes a second bend spaced a second distance from the second end, the second distance being greater than a depth of insertion of the second end into the AR-10 magwell.

11. The apparatus of claim 1, wherein the first gap between and defined by the first set of prongs is U-shaped and wherein the second gap between and defined by the second set of prongs is U-shaped.

12. The apparatus of claim 1, wherein a thickness of the elongate bar is less than the first and second widths of the elongate bar and wherein a top surface and a bottom surface of the elongate bar from proximate the first end to proximate the second end of the elongate bar are substantially planar and parallel.

13. A bolt carrier unjamming apparatus used in combination with a first bolt shaft of a first smaller magwell of a first firearm and a second bolt shaft of a second larger magwell of a second firearm, comprising:

an elongate bar having a first end and a second end, and a long axis extending between the first end and the second end;

a first pair of elongate prongs integrally formed with and longitudinally extending from the first end of the bar, the first pair of elongate prongs defining first inner and outer substantially parallel surfaces, the first outer substantially parallel surfaces spaced apart approximately 1.8 cm so that the first pair of elongate prongs are configured to fit within the first magwell of the first firearm, the first pair of elongate prongs defining a first gap between the first pair of elongate prongs configured to extend around the first bolt shaft of the first firearm; and a second pair of elongate prongs integrally formed with and longitudinally extending from the second end of the bar, the second pair of elongate prongs defining second inner and outer substantially parallel surfaces, the second outer substantially parallel surfaces spaced apart approximately 2.5 cm so that the second pair of elongate prongs are configured to fit within the second magwell of the second firearm, the second pair of elongate prongs defining a second gap between the second pair of elongate prongs configured to extend around the second bolt shaft of the second firearm.

14. The apparatus of claim 13, wherein each of the first pair of elongate prongs is tapered in thickness from proximate the first end of the bar to free ends of the first pair of elongate prongs.

15. The apparatus of claim 13, wherein each of the second pair of elongate prongs is tapered in thickness from proximate the second end of the bar to free ends of the second pair of elongate prongs.

16. The apparatus of claim 13, wherein the first firearm comprises an AR-15.

17. The apparatus of claim 13, wherein the second firearm comprises an AR-10.

18. The apparatus of claim 13, wherein the first outer surfaces of the first pair of prongs are contiguous and linear with corresponding outer surfaces of the bar at the first end of the bar and the second outer surfaces of the second pair of prongs are contiguous and linear with corresponding outer surfaces of the bar at the second end of the bar.

19. The apparatus of claim 13, wherein a first thickness of the bar is less than the first and second widths of the bar and wherein a top and bottom surface of the bar from proximate the first end to proximate the second end of the bar are substantially planar and substantially parallel.

20. The apparatus of claim 19, wherein a thickness of the first pair of prongs is tapered from the first thickness of the elongate bar to a second thickness proximate terminal ends of the first pair of prongs that is less than the first thickness and wherein a thickness of the second pair of prongs is tapered from the first thickness of the bar to a second thickness proximate terminal ends of the second pair of prongs that is less than the first thickness.

* * * * *